US007040265B2

(12) United States Patent
Falkowski et al.

(10) Patent No.: US 7,040,265 B2
(45) Date of Patent: May 9, 2006

(54) MULTIPLE DISPLACEMENT SYSTEM FOR AN ENGINE

(75) Inventors: Alan G. Falkowski, Lake Orion, MI (US); Mark R. McElwee, Lake Orion, MI (US); Joel A. Baker, Algonac, MI (US); Glen D. Hendershott, Clarkston, MI (US); Constantin Hagiu, Windsor (CA); Mark Koeroghlian, Austin, TX (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/859,033

(22) Filed: Jun. 2, 2004

(65) Prior Publication Data

US 2004/0244744 A1 Dec. 9, 2004

Related U.S. Application Data

(60) Provisional application No. 60/475,276, filed on Jun. 3, 2003.

(51) Int. Cl.
*F01L 1/34* (2006.01)

(52) U.S. Cl. ..... 123/90.16; 123/90.13; 123/90.12; 123/198 F; 123/90.38; 29/888.06

(58) Field of Classification Search ..... 123/90.12, 123/90.13, 90.15, 90.16, 90.22, 90.23, 90.31, 123/90.33, 90.38, 90.48, 90.55, 193.1, 193.3, 123/193.5, 195 AC, 195 HC, 196 M, 198 F; 29/888.06

See application file for complete search history.

(56) References Cited

U.S. PATENT DOCUMENTS

| | | | | |
|---|---|---|---|---|
| 4,151,824 | A | 5/1979 | Gilbert | |
| 4,576,128 | A | 3/1986 | Kinichi | |
| 5,347,964 | A | 9/1994 | Reguiero | |
| 5,351,662 | A * | 10/1994 | Dopson et al. | 123/90.16 |
| 5,357,916 | A | 10/1994 | Matterazzo | |
| 5,445,119 | A | 8/1995 | Regueiro | |
| 5,549,081 | A | 8/1996 | Ohlendorf et al. | |
| 5,553,584 | A | 9/1996 | Konno | |
| 5,570,665 | A | 11/1996 | Regueiro | |
| 5,577,470 | A | 11/1996 | Leydorf, Jr. et al. | |
| 5,592,907 | A | 1/1997 | Hasebe et al. | |
| 5,613,469 | A | 3/1997 | Rygiel | |
| 5,626,110 | A | 5/1997 | Regueiro | |

(Continued)

*Primary Examiner*—Thomas Denion
*Assistant Examiner*—Kyle M. Riddle
(74) *Attorney, Agent, or Firm*—Thomas A. Jurecko

(57) ABSTRACT

A cylinder deactivation arrangement for an engine is provided. The arrangement includes an engine with main oiling circuit passages and lifter oil gallery control circuit passages formed internal to a cylinder block of the engine. The lifter oil gallery control circuit is arranged so as to provide an oil flow path internal to the cylinder block from the main oiling circuit to the deactivating lifter. A lifter is positioned in the cylinder block and arranged in fluid communication with the lifter oil gallery control circuit. A control valve is positioned in the cylinder block and arranged in fluid communication with the main oiling circuit and the lifter oil gallery control circuit. The control valve is arranged to allow selective fluid communication of oil from the main oiling circuit to the lifter oil gallery control circuit to selectively control actuation of the lifter.

10 Claims, 4 Drawing Sheets

U.S. PATENT DOCUMENTS 5,638,783 A 6/1997 Regueiro
5,645,023 A 7/1997 Regueiro
5,653,198 A 8/1997 Diggs
5,660,153 A 8/1997 Hampton et al.
5,673,660 A 10/1997 Regueiro
5,697,333 A 12/1997 Church et al.
5,765,515 A 6/1998 Letsche
5,809,950 A 9/1998 Letsche et al.
5,809,956 A 9/1998 Regueiro
5,893,344 A 4/1999 Church
5,908,015 A 6/1999 Kreuter
5,921,209 A 7/1999 Regueiro
5,921,210 A 7/1999 Regueiro
5,924,396 A 7/1999 Ochiai et al.
5,960,756 A 10/1999 Miyachi et al.
6,006,706 A 12/1999 Kanzaki
6,032,624 A 3/2000 Tsuruta et al.
6,092,497 A 7/2000 Preston et al.
6,318,316 B1 * 11/2001 Tsukui et al. ..... 123/90.16
6,318,324 B1 11/2001 Koeroghlian et al.
6,435,150 B1 8/2002 Loughlin et al.
6,513,480 B1 * 2/2003 Albertson et al. ..... 123/198 F
6,557,518 B1 * 5/2003 Albertson et al. ..... 123/198 F
6,568,365 B1 5/2003 Hannon et al.
6,584,951 B1 * 7/2003 Patel et al. ..... 123/198 F
6,615,804 B1 9/2003 Matthews et al. ..... 123/481
6,655,353 B1 12/2003 Rayl ..... 123/198 F
6,802,288 B1 * 10/2004 Spath ..... 123/90.16

* cited by examiner

MULTIPLE DISPLACEMENT SYSTEM FOR AN ENGINE

CROSS REFERENCE TO RELATED APPLICATION(S)

This application claims benefit of U.S. Provisional Application No. 60/475,276 filed on Jun. 3, 2003.

FIELD OF THE INVENTION

The present invention relates generally to an engine for a motor vehicle, and, more particularly, to a variable displacement engine for a motor vehicle powertrain.

BACKGROUND OF THE INVENTION

In vehicle design, fuel economy is becoming increasingly important. To that end, fuel conservation and engine system design play a significant role. In addition, with the popularity of sport utility vehicles and performance luxury cars, and with increasing competition in the automotive market, superior engine refinement coupled with strong engine performance are necessary deliverables for an engine to satisfy many of today's automotive consumer requirements.

To satisfy the performance aspect, larger displacement engines, such as a V-6 or V-8 engine, are typically developed for these vehicles. As is known, these larger displacement engines generally do not realize the same fuel economy as a smaller displacement engine. To that end, variable displacement engines can provide for fuel economy benefits by operating on the principle of cylinder deactivation. During operating conditions that require high output torque, such as acceleration, every cylinder of a variable displacement engine is arranged to be activated. In contrast, for low load conditions, such as steady cruising, cylinders may be deactivated to improve fuel economy for the variable displacement engine vehicle.

While such variable displacement engines provide advantages of improved fuel economy, conventional cylinder deactivation systems of these arrangements rely on add-on engine componentry, such as externally coupled hydraulic fluid passages, that increase engine cost and complexity as well as create additional sources for potential hydraulic fluid leakage from the engine.

SUMMARY OF THE INVENTION

Accordingly, an apparatus is provided to deactivate a selected cylinder of an engine to improve fuel economy. In accordance with one aspect of the present invention, the engine includes a cylinder block with a main oiling circuit having passages formed internal to the cylinder block. A deactivating lifter is positioned in the cylinder block and arranged to be selectively actuated upon flow of oil to the deactivating lifter at a pressure substantially of the main oiling circuit. The engine further includes a lifter oil gallery control circuit formed internal to the cylinder block for providing oil to the deactivating lifter additional to oil provided to the lifter from the main oiling circuit. The lifter oil gallery control circuit is arranged so as to provide an oil flow path internal to the cylinder block from the main oiling circuit to the deactivating lifter. A control valve is provided in fluid communication with the main oiling circuit and the lifter oil gallery control circuit wherein the control valve is arranged to allow selective flow of oil at a pressure substantially of the main oiling circuit from the main oiling circuit to the lifter oil gallery control circuit to selectively control actuation of the lifter.

In accordance with another aspect of the present invention, the lifter oil gallery control circuit internal passages are arranged to naturally purge air from the passages.

BRIEF DESCRIPTION OF THE DRAWINGS

Other aspects, features, and advantages of the present invention will become more fully apparent from the following detailed description of the preferred embodiment, the appended claims, and in the accompanying drawings in which:

DETAILED DESCRIPTION OF THE PREFERRED EMBODIMIENT

Figure 1:
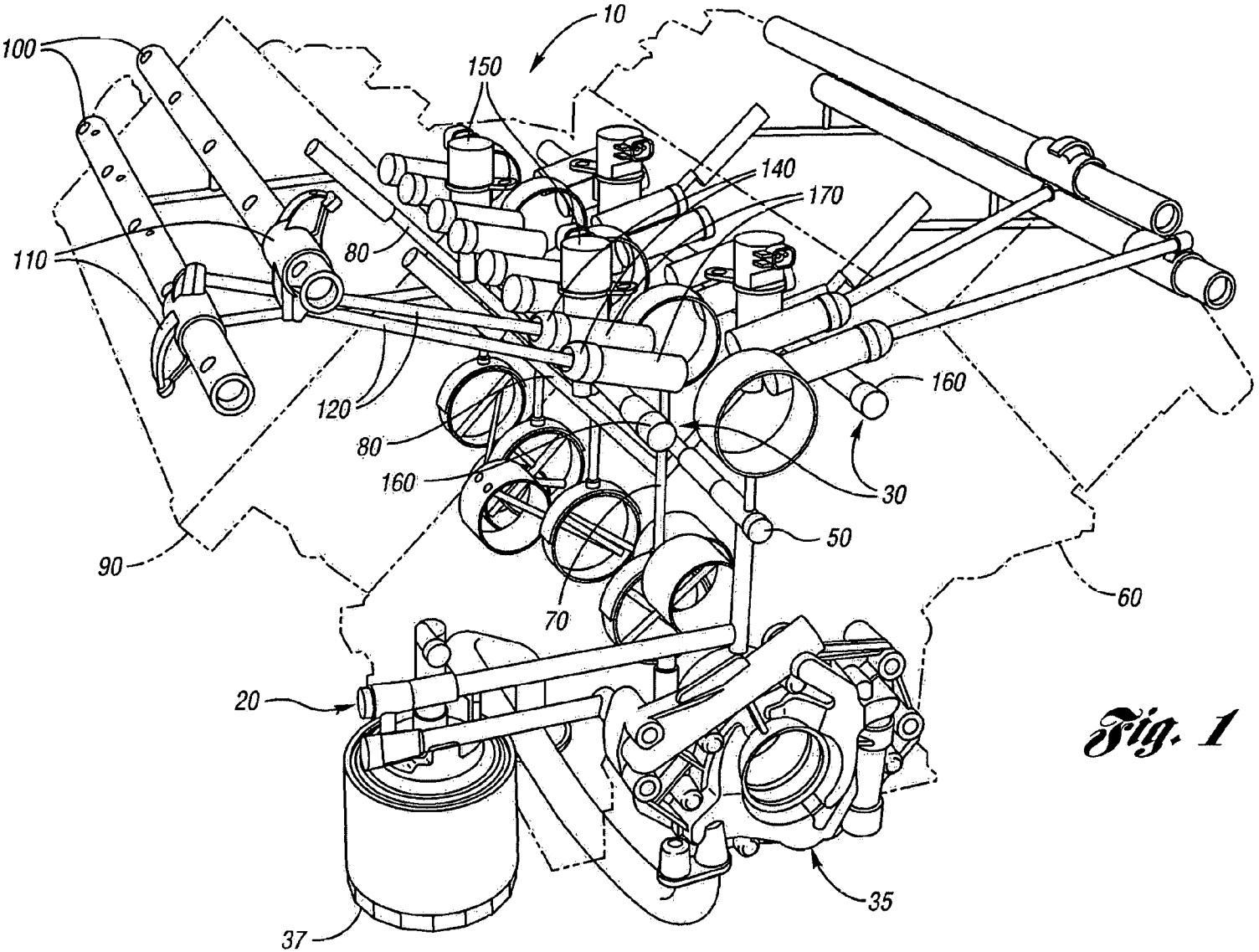
FIG. 1 illustrates an isometric view of an exemplary embodiment of a V-8 engine having a main oiling circuit and a lifter oil gallery control circuit in accordance with the present invention.
Figure 2:
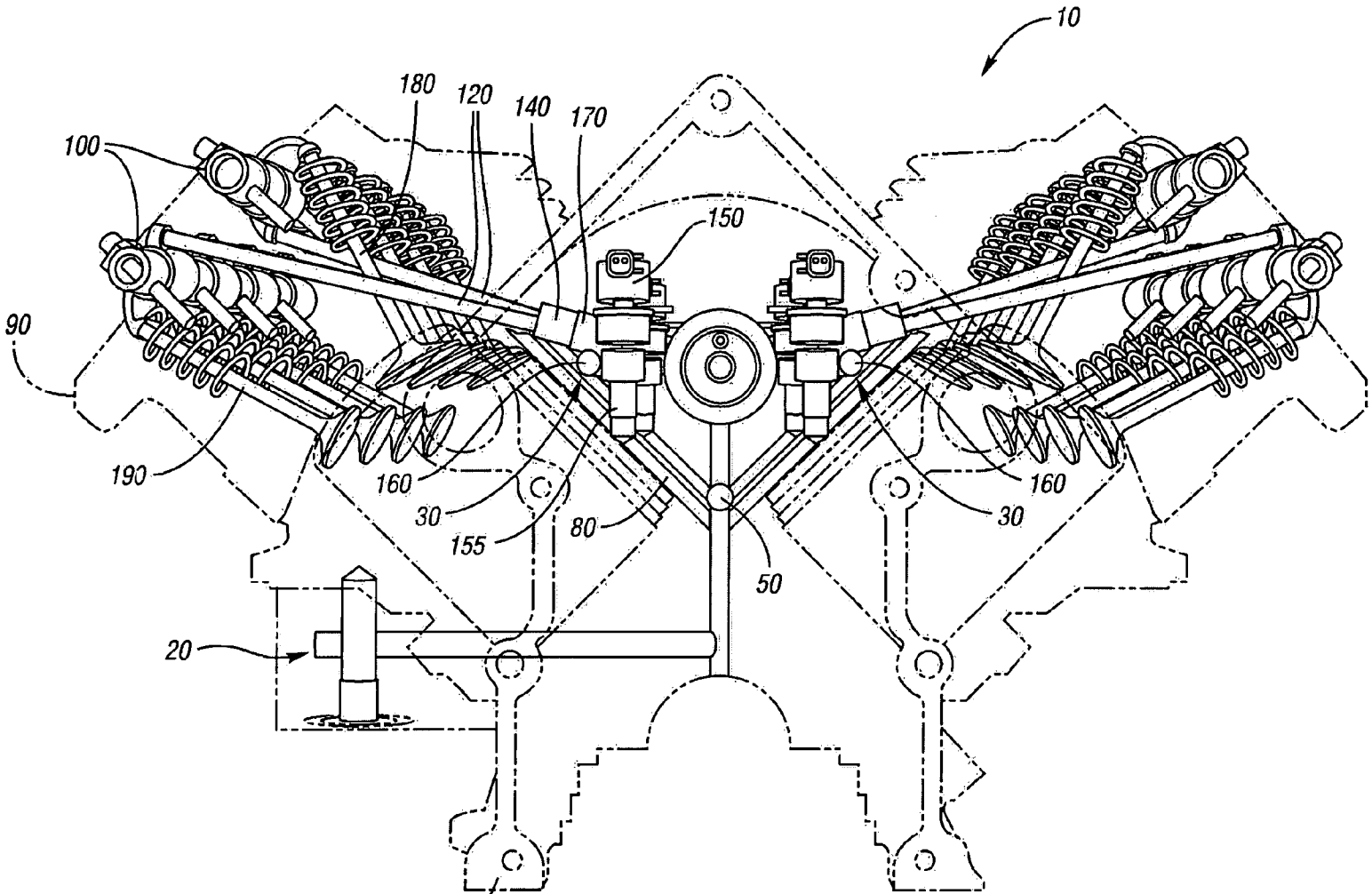
FIG. 2 illustrates a front view of the engine shown in FIG. 1 and including valve train componentry in accordance with the present invention.
Figure 3:
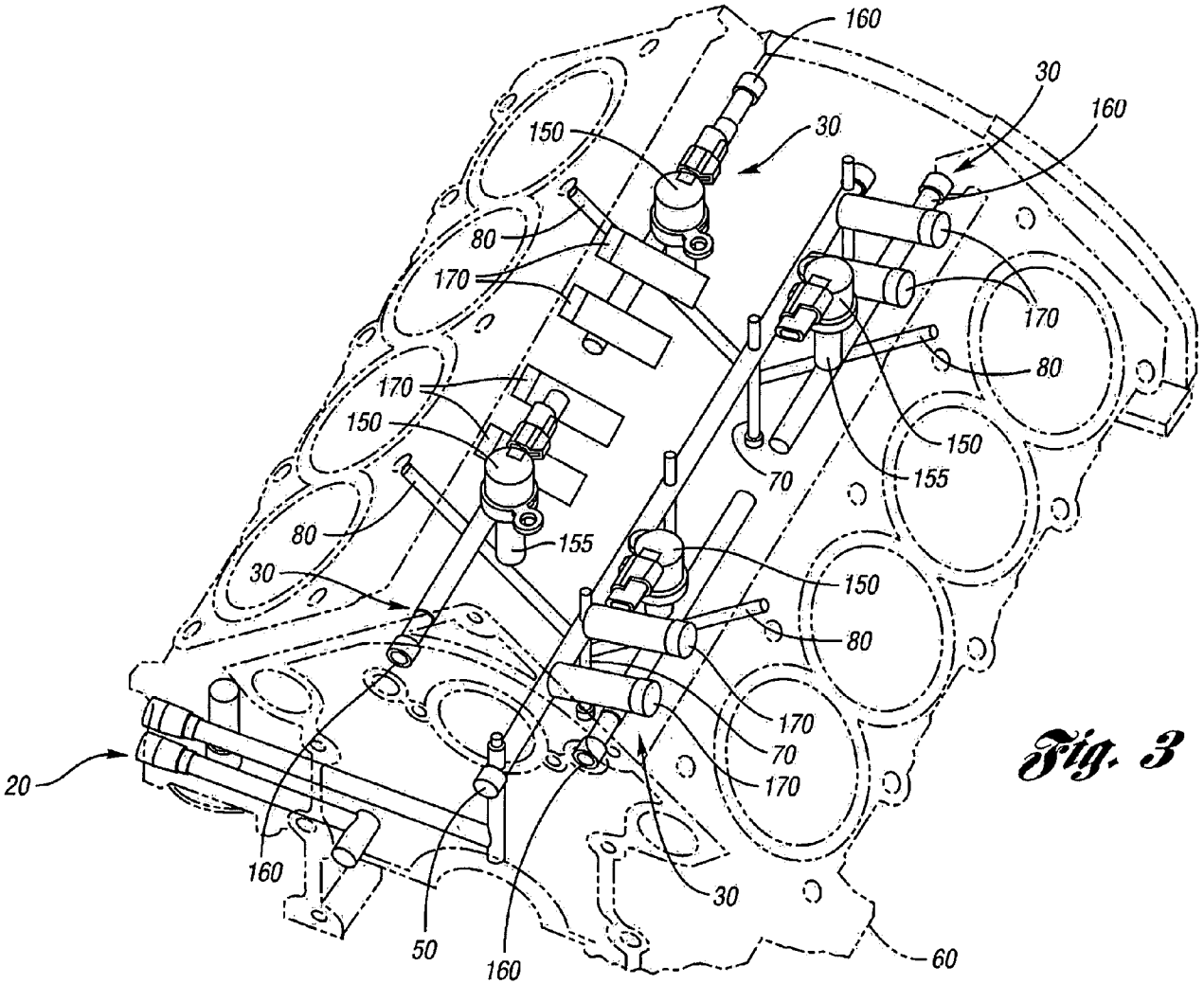
FIG. 3 illustrates an isometric view of the engine shown in FIG. 1 highlighting a cylinder block and aspects of the main oiling circuit and the lifter oil gallery control circuit for cylinders arranged to be selectively deactivated in accordance with the present invention.

In the following description, several well-known features of an internal combustion engine are not shown or described so as not to obscure the present invention. Referring now to the drawings, FIGS. 1, 2 and 3 illustrate an exemplary embodiment of an engine 10 with a main oiling circuit 20 and a lifter oil gallery control circuit 30 arranged to deactivate selective cylinders to improve fuel economy. Main oiling circuit 20 provides a path for oil flow from an oil pump 35 through an oil filter 37 and into a main oil gallery 50 of cylinder block 60. Feed passages 70 provide a flow path between the main oil gallery 50 and a crankshaft oiling circuit 40. Main oil gallery 50 is then generally used to further feed a plurality of other passages and components. Most relevant to this invention are feed passages 80 that continue from feed passages 70 and serve as the feed passages to cylinder heads 90.

Cylinder heads 90 in the exemplary embodiment utilize a top down oiling arrangement where the oil feed passages 80 continue through the cylinder head 90 via interface with rocker shafts 100. From the rocker shafts, oil travels through the respective rocker arms 110 and then through hollow push rods 120. From the push rods, the oil then travels into a deactivating lifter 140 to provide hydraulic pressure to a lash adjuster 134 (FIG. 4) housed within the deactivating lifter 140. Oil then flows through conventional oil drain backs (not shown) into an oil pan (not shown).

Feed passages 80, in addition to feeding the cylinder head, provide an oil supply to the lifter oil gallery control circuit 30. As oil flows through feed passages 80 towards cylinder heads 90, solenoid control valve 150 positioned in a bore 155 formed in cylinder block 60 is arranged to selectively provide high pressure oil flow to lifter oil gallery 160. Lifter oil gallery 160 is connected to and interacts with a lifter bore 170 that houses the deactivating lifter 140. Also, the lifter oil gallery control circuit 30 is laid out in a manner that naturally purges air from the lifter oil gallery control circuit passages. This is accomplished by utilizing a bottom up oil passage architecture incorporated into cylinder block 60 and the oil feeding passages of cylinder heads 90. For example, the bottom up oiling architecture allows any air that travels into feed passages 80 to travel up to the rocker shafts 100, a high point in the system and beyond the oil gallery lifter control circuit 30. In addition, any air that migrates from feed passage 80 into the lifter oil gallery 160 is allowed to purge from the system through natural oil leakage between the lifter bore 170 and the deactivating lifter 140.

Figure 4:
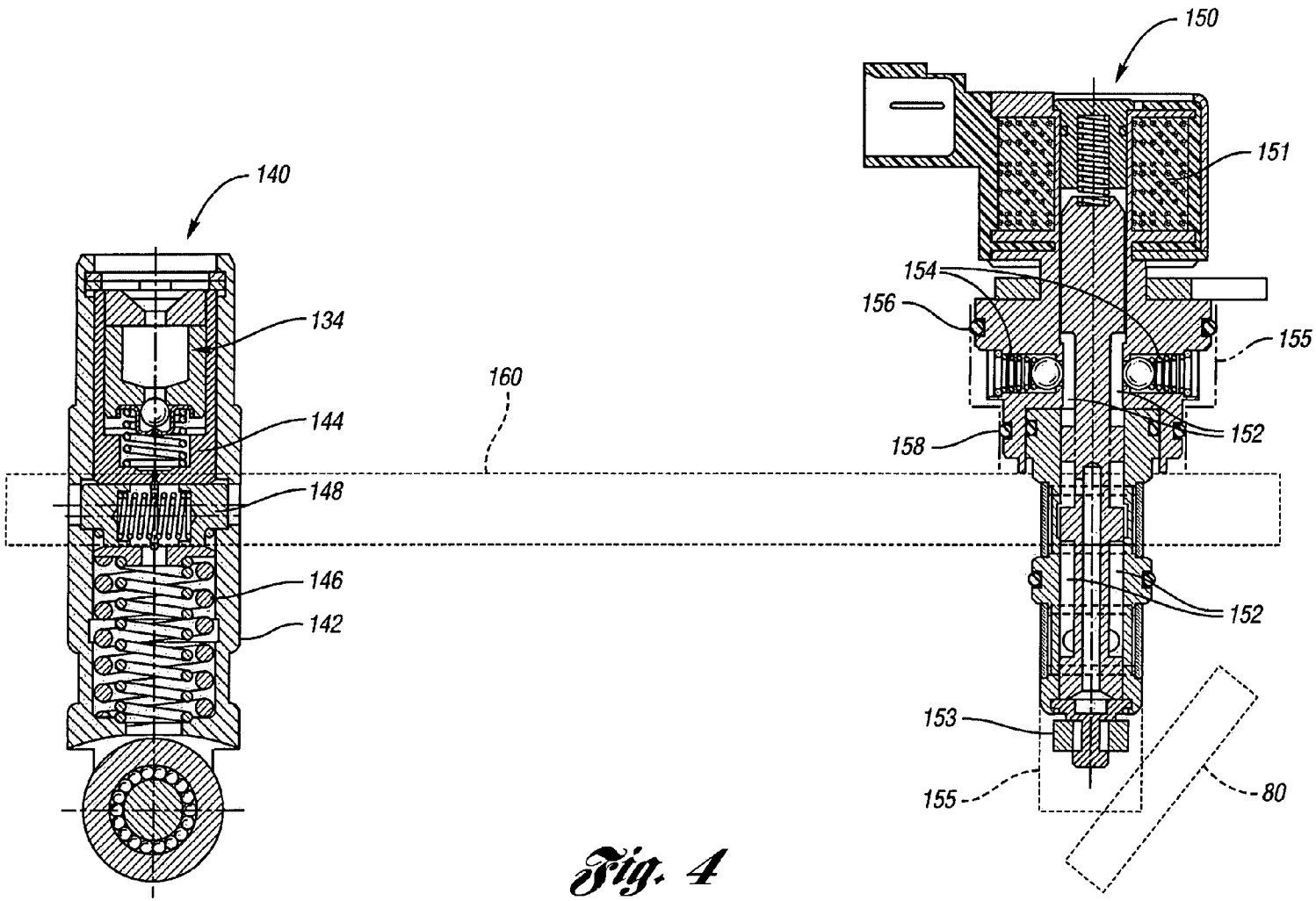
FIG. 4 illustrates aspects of the lifter oil gallery control circuit including a control valve and a deactivating lifter in accordance with the present invention.

In operation and referring to FIGS. 2, 3 and 4, to deactivate a cylinder both the intake valve 180 and the exhaust valve 190 are turned off by decoupling these valves from the valve train. This is accomplished through a series of sequential events. At a proper time in the engine cycle, the engine solenoid control valve 150 is energized and this opens a flow path for oil from feed passage 80 through the control valve 150 and into lifter oil gallery 160. This raises the oil pressure in lifter oil gallery 160 to that of the main oiling circuit 10 (high pressure oil) and this in turn deactivates a locking mechanism in deactivating lifter 140 allowing the lifter to absorb camshaft input without activating the intake and exhaust valves as further described below.

Deactivating lifter 140, like a conventional lifter, houses the hydraulic lash adjuster 134 and also includes an outer body 142 with an inner body 144 and a lost motion spring 146 between the two bodies. The inner body has a pair of pins 148 that extend or retract in response to oil pressure below or above predetermined high or low thresholds, respectively. When extended, the pins 148 sit on a groove formed on the inside of the outer body 142, locking the inner and outer bodies together. In response to high oil pressure, the pins 148 are arranged to retract and enable relative motion between the outer and inner bodies of the lifter and decouple the camshaft input from a specific intake or exhaust valve of the respective cylinder to be deactivated. For a given cylinder that is arranged to be selectively deactivated, one solenoid control valve 150 is used to control two deactivating lifters 140, one lifter for the intake valve 180 and one lifter for exhaust valve 190. When deactivated, the lost motion spring 146 supplies a force necessary to ensure contact is maintained between valvetrain components. Applicants hereby incorporate by reference commonly owned copending patent application Ser. No. 10/859,024 filed on Jun. 2, 2004 and entitled *Deactivating Valve Lifter.*

To reactivate deactivated cylinders, removing the energizing voltage source from a solenoid 151 of the control valve 150 substantially closes the flow path through the valve into the lifter oil gallery 160 and simultaneously opens a pressure relief valve 154 within control valve 150 resulting in the oil pressure falling to a nominal pressure, such as 3 psi. This resultant loss in pressure removes the hydraulic pressure necessary to force retraction of the lifter pins 148 and thus the pins 148 of the inner lifter housing 144 reengage the outer lifter housing 142 which eliminates relative motion of the lifter and re-couples the lifter to valve train cam input.

In addition to controlling hydraulic pressure necessary to activate and deactivate cylinders of the engine, the control valve 150 also maintains a nominal oil pressure in the deactivating lifter oil gallery circuit control 30 through a combination of an internal passage 152 in the control valve and the pressure relief valve 154. The internal passage allows a restricted flow of oil into the lifter gallery 160 and the pressure relief valve maintains pressure in the lifter oil gallery at a nominal 3 psi when the control valve is in the closed position. Control valve 150 seals at o-ring 156 and o-ring 158 in the bore 155 formed in cylinder block 60. O-ring 156 prevents oil from leaking external to the engine and o-ring 158 prevents oil flowing past the pressure relief valve from interacting with lifter oil gallery 160. Thus, any oil that flows past relief valve 154 collects in the lifter bore 170 between the o-rings and then drains though a conventionally designed oil drainback passage (not shown). Maintaining this nominal oil pressure is desirable to enable an optimum response time for deactivation and reactivation events such that these respective events are not discernable to a vehicle operator. A magnet 153 located on the nose of the unit collects ferrous debris to minimize the contamination of the valve and lifters.

In today's competitive automotive environment, it is increasingly important for automotive OEM's to provide a product that satisfies customer expectations in a cost effective manner. For engines, especially a larger displacement V-8 engine, this generally breaks down to providing a low warranty risk, low leak potential engine with significant horsepower while meeting government fuel economy requirements and all in a cost effective manner.

The MDS engine architecture for this exemplary embodiment represents a system fully integrated into the engine block hardware providing for a lower cost, lower complexity system while also minimizing potential oil leak paths. Integrating all of the oil control and flow passages directly into the block as well as having the control valve mount directly to the engine block via a bore formed in the block greatly reduces the amount of oil leak paths, especially when compared to an add-on or bolt-on oil hardware system. In addition, using formed passages and bores in the engine block reduces manufacturing and component complexity through both a minimization of engine assembly operations and a reduction in the number of system components, both of which also reduce cost. For example, in the exemplary embodiment there is a separate lifter oil gallery control circuit for each cylinder arranged to be selectively deactivated and each lifter oil gallery can be formed (i.e., drilled) from the front or rear face of the engine block for ease of manufacturing. Finally, the architecture of the main and lifter oil gallery circuits result in a design that naturally purges air from the system and thus eliminates the need for an additional and/or external purge air device.

The foregoing description constitutes the embodiments devised by the inventors for practicing the invention. It is apparent, however, that the invention is susceptible to modification, variation, and change that will become obvious to those skilled in the art. Inasmuch as the foregoing description is intended to enable one skilled in the pertinent art to practice the invention, it should not be construed to be limited thereby but should be construed to include such aforementioned obvious variations and be limited only by the proper scope or fair meaning of the accompanying claims.

What is claimed is:

1. An engine having an arrangement for deactivating a predetermined cylinder, the engine comprising:

a cylinder block;

a main oiling circuit with passages formed internal to the cylinder block;

a deactivating lifter positioned internal to the cylinder block and arranged to be selectively actuated upon flow of oil to the deactivating lifter at a pressure substantially of the main oiling circuit;

a lifter oil gallery control circuit formed internal to the cylinder block for providing oil to the deactivating lifter additional to oil provided to the lifter from the main oiling circuit, and the lifter oil gallery control circuit is arranged so that an oil flow path from the main oiling circuit to the deactivating lifter extends internal to the cylinder block; and a control valve in fluid communication with the main oiling circuit and the lifter oil gallery control circuit;

wherein the control valve is arranged to allow selective flow of oil at a pressure substantially of the main oiling circuit from the main oiling circuit to the lifter oil gallery control circuit to control actuation of the lifter.

2. The engine of claim 1, wherein the lifter oil gallery control circuit includes:

a deactivating lifter bore formed in the cylinder block, the deactivating lifter bore arranged in fluid communication with the lifter oil gallery control circuit, wherein the deactivating lifter is positioned within the deactivating lifter bore; and a control valve bore formed in the cylinder block, the control valve bore is arranged in fluid communication with the main oiling circuit and the lifter oil gallery control circuit, the control valve is positioned within the control valve bore.

3. The engine of claim 1, wherein the lifter gallery control circuit is arranged to purge air from the lifter oil gallery control circuit.

4. The engine of claim 1, wherein the engine further comprises a plurality of selectively deactivatable cylinders, and a dedicated lifter oil gallery control circuit is provided for each deactivatable cylinder.

5. The engine of claim 4, wherein the engine comprises eight cylinders and four of the eight cylinders are arranged to be selectively deactivated.

6. The engine of claim 1, further comprising a deactivating lifter for each valve of a deactivatable cylinder.

7. The engine of claim 1, wherein the deactivating lifter is arranged to be selectively reactivated in response to interruption of the flow of oil to the deactivating lifter at a pressure substantially of the main oiling circuit thereby reactivating the respective valve of the cylinder to input from the valvetrain.

8. The engine of claim 1, wherein the control valve is arranged to be actuated in response to a signal from an engine controller.

9. The engine of claim 1, wherein the control valve is further arranged to allow flow of low pressure oil to pass through the control valve into the lifter oil gallery control circuit to maintain a constant supply of oil in the circuit when the control valve is not actuated.

10. The engine of claim 1, wherein the control valve comprises a solenoid controlled valve.

* * * * *